United States Patent [19]

Langdon et al.

[11] 4,298,408

[45] Nov. 3, 1981

[54] ALUMINUM-TITANIUM-BORON MASTER ALLOY

[75] Inventors: C. Ray Langdon, Pottstown; Alan R. Burkart, Reading, both of Pa.

[73] Assignee: Cabot Berylco Inc., Reading, Pa.

[21] Appl. No.: 110,159

[22] Filed: Jan. 7, 1980

[51] Int. Cl.[3] ..... C22C 21/00

[52] U.S. Cl. ..... 148/32; 75/138

[58] Field of Search ..... 75/138; 148/32

[56] References Cited

U.S. PATENT DOCUMENTS 3,785,807 1/1974 Backerud ..... 75/138

3,857,705 12/1974 Miyasaka et al. ..... 75/138

*Primary Examiner*—R. Dean

*Attorney, Agent, or Firm*—Joseph J. Phillips; Jack Schuman

[57] ABSTRACT

An aluminum-titanium-boron master alloy is provided that is characterized by an optimum promotion of fine grain together with sufficient ductility for it to be produced in the form of a wrought product, for example, continuous rod. The alloy of this invention preferably contains about 8 weight percent titanium, about 0.4 weight percent boron and the balance essentially aluminum and incidental impurities normally found in alloys of this class.

4 Claims, No Drawings

ALUMINUM-TITANIUM-BORON MASTER ALLOY

This invention relates to an aluminum-titanium-boron master alloy for use in the promotion of uniform small grains in aluminum castings and in a method of manufacture of this class of master alloys.

In the preparation of aluminum and aluminum alloys, it is the general practice to add a master alloy to the molten aluminum or aluminum alloy, before casting, to obtain a fine grain structure in the resultant cast aluminum. Many compositions have been proposed and used for this purpose. Well known in the art are aluminum master alloys containing titanium and boron. U.S. Pat. Nos. 3,857,705 and 3,785,807 disclose typical master alloys of this class. Master alloys produced from the teachings of these patents are effective in the production of fine grain aluminum castings. The master alloys disclosed in the prior art are commercially available generally in the form of as-cast products or optionally in the form of metal powder. Table 1 presents the compositions of these prior art master alloys.

TABLE 1

| | Prior Art Compositions In Weight Percent | | |
|---|---|---|---|
| | U.S. Pat. No. 3,785,807 | | |
| | Broad | Preferred | U.S. Pat. No. 3,857,705 |
| Titanium | 2–10 | 0.02 to 6 | 3.5 to 7.5 |
| Boron | .3–5 | 0.01 to 2 | .1 to .3 |
| Aluminum | Balance | Balance | Balance |
| Form | Cast | TiB $TiB_2$ in Al(Cast) | Cast |
| Ratio Ti:B | 5:1 | 5:1 | 30:1 |

The production of fine grain aluminum products is somewhat limited as a continuous process because prior art master alloys in the form of cast or powder additions are not easily adapted to facilitate continuous processing. Attempts to solve the problem by various master alloy feed systems and the like have not proven to be adequate. Thus, the production of fine grain aluminum products remains essentially as a batch or semi-continuous process.

It is an object of this invention to provide an aluminum master alloy that promotes optimum grain refinement of aluminum castings.

It is another principal object of this invention to provide an aluminum master alloy that may be produced by a variety of processes, for example, in form of castings, metal powder, and wrought products.

These and other objects and advantages apparent to those skilled in the art may be obtained by the master alloy compositions disclosed in Table 2 and available in various forms.

TABLE 2

| | MASTER ALLOY OF THIS INVENTION In Weight Percent | | |
|---|---|---|---|
| | Broad | Preferred | Optimum |
| Titanium | 7.5 to 10 | 7.5 to 8.5 | about 8 |
| Boron | .3 to .6 | .35 to .5 | about .4 |
| Aluminum | Balance | Balance | Balance |
| Form | Cast or Wrought | Cast or Wrought | Cast or Wrought |
| Ratio Ti:B | 13 to 30:1 | 15 to 25:1 | 20:1 |

Titanium must be present within the ranges indicated in Table 2. Higher titanium contents tend to yield more brittle master alloys that are more difficult to produce in wrought form. Lower titanium contents tend to produce master alloys that are less effective in the promotion of fine grain in the ultimate aluminum product.

Boron must be present within the ranges indicated in Table 2. Higher boron contents tend to promote the formation of excessive borides in the master alloy. Lower boron contents tend to produce master alloys that are less effective in the promotion of fine grain in the ultimate aluminum product.

It is well known in the metallurgical arts that the production of a wrought product is dependent upon the ductility of the alloy. There must be sufficient ductility to work the alloy into the desired configuration. Alloys of this class generally do not require any degree of ductility because they are produced in the "as cast" condition or in the form of particulated material, such as powder.

This invention provides an alloy with sufficient ductility for working into a rod. The alloy of this invention thereby facilitates the production of aluminum alloys as a continuous process.

The titanium-to-boron ratios suggested in Table 2 are useful as a guide to prevent exceeding the preferred balance of these elements in the master alloy. The suggested ratios are also a guide in the production of adequately ductile master alloys for production in the wrought form.

Results from a series of experiments have shown that alloys made within the composition range of Table 2 may be produced in the form of a wrought continuous rod. The provision of an optimum master alloy in the form of a rod represents an important advancement in the aluminum casting industry. Master alloy additions made by a rod promote the continuous production of aluminum castings and also provide a more uniform product. Thus, the continuous processing of aluminum is provided as discussed hereinabove.

A series of tests was made to establish (1) the optimum composition of master alloy for yielding fine grain structure in castings and (2) the optimum composition of master alloy having sufficient ductility to be worked into a continuous coil of $\frac{3}{8}$-inch rod. Testing was performed on an especially designed integrated continuous casting and rod rolling mill. The alloy was melted to desired composition and continuous cast into $1\frac{1}{2}$ inch diameter bar. The bar was then continuously reduced to $\frac{3}{8}$-inch diameter rod in ten stages of reduction. The bar and rod sizes were chosen as convenient working units. Other sizes and shapes may be produced, for example $\frac{1}{8}$-inch rod, depending upon the specific aluminum casting need. The bar and/or rod may be in the shape of a rectangle, square or any other cross-sectional configuration.

Testing to determine optimum composition for effective fine grain control resulted in the composition ranges shown in Table 2. The best practice alloy appeared to be about 7.5% titanium, 0.3 boron and the balance aluminum. However, subsequent tests to determine the optimum composition for ductility indicated that about 8% titanium 0.4% boron is the optimum compromise for the best results. These compositions have been determined as averages of many experimental values. The ranges, as indicated in Table 2, have been proposed as an effective guide in commercial production when the requirements for ductility are not critical. In essence, the effective working range for the optimum composition of this invention appears to be about 7.5 to about 8% titanium, about 0.3 to about 0.4% boron and the balance essentially aluminum plus impurities normally associated with alloy of this class.

The master alloy of this invention may be melted and produced by methods well known in the art. The master alloy of this invention is not limited in any way regarding the method of melting and controlling compositions.

The integrated continuous casting and rod rolling unit was specifically designed for the production of rod. The unit is not part of this invention. In the preparation of the wrought experimental alloys, no unusual problems were noted.

Ductile properties of the master alloy of this invention were developed as required for production on the specially designed unit. The ductile properties are equally required with the use of any of the well-known conventional equipment that are necessary to produce cast or wrought articles. Persons skilled in the art, of course, are able to process the master alloy of this invention by any other well-known wrought processes.. As noted above, no unusual problems are expected in wrought processing. Of course, it is understood that the master alloy of this invention may also be produced in the form of castings, powder, cast rod and the like. Processing by means of a cast bar and wrought shape is preferred.

Certain preferred compositional ranges and embodiments of this invention have been set out in the foregoing specification; however, it will be understood that this invention may be otherwise embodied within the scope of the following claims.

What is claimed is:

1. A wrought master alloy having sufficient ductility to be worked into a continuous coil of $\frac{3}{8}$-inch rod and consisting essentially of, in weight percent; 7.5 to 10 titanium, 0.3 to 0.6 boron and the balance aluminum plus incidental impurities.

2. The master alloy of claim 1 wherein the titanium is 7.5 to 8.5 and the boron is 0.35 to 0.5.

3. The master alloy of claim 1 wherein the titanium is 7.5 to 8 and the boron is 0.3 to 0.4.

4. The master alloy of claim 1 wherein the titanium is about 8 and the boron is about 0.4.

* * * * *